US006477995B2

(12) United States Patent
Eder et al.

(10) Patent No.: US 6,477,995 B2
(45) Date of Patent: Nov. 12, 2002

(54) ELECTROMAGNETIC ACTUATOR FOR ACTUATING A LIFTING VALVE OF AN INTERNAL COMBUSTION ENGINE

(75) Inventors: Torsten Eder; Wolfgang Hundt, both of München; Volker Warnecke, Nittendorf; Hanspeter Zink, Regensburg, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/013,226

(22) Filed: Dec. 10, 2001

(65) Prior Publication Data

US 2002/0083909 A1 Jul. 4, 2002

Related U.S. Application Data

(63) Continuation of application No. PCT/EP00/03835, filed on Apr. 27, 2000.

(30) Foreign Application Priority Data

Jun. 10, 1999 (DE) ..... 199 26 413

(51) Int. Cl.[7] ..... F01L 1/00
(52) U.S. Cl. ..... 123/90.11
(58) Field of Search ..... 123/90.11; 251/129.01, 251/129.1, 126.16

(56) References Cited

U.S. PATENT DOCUMENTS

| | | | | |
|---|---|---|---|---|
| 5,769,043 A | | 6/1998 | Nitkiewicz | 123/90.11 |
| 6,247,431 B1 | * | 6/2001 | Toriumi | 123/90.11 |

FOREIGN PATENT DOCUMENTS

| | | |
|---|---|---|
| DE | 196 11 547 A1 | 9/1997 |
| DE | 197 06 106 A1 | 8/1998 |
| DE | 197 43 913 A1 | 12/1998 |
| DE | 197 55 271 A1 | 6/1999 |
| EP | 0 376 716 | 7/1990 |
| EP | 1 004 755 A2 | 5/2000 |
| JP | 03189312 | 8/1991 |

* cited by examiner

*Primary Examiner*—Weilun Lo
(74) *Attorney, Agent, or Firm*—Laurence A. Greenberg; Werner H. Stemer; Ralph E. Locher

(57) ABSTRACT

An electromagnetic actuator for actuating a lifting valve of an internal combustion engine includes two magnetic coils and an armature moved in oscillation between the two magnetic coils. The armature has an armature shank with an end portion. The armature shank is guided in the actuator. The end portion is connected to and acts upon the valve shank of the lifting valve. At least portions of the armature shank are of a material having a specific gravity substantially lower than that of steel.

48 Claims, 1 Drawing Sheet

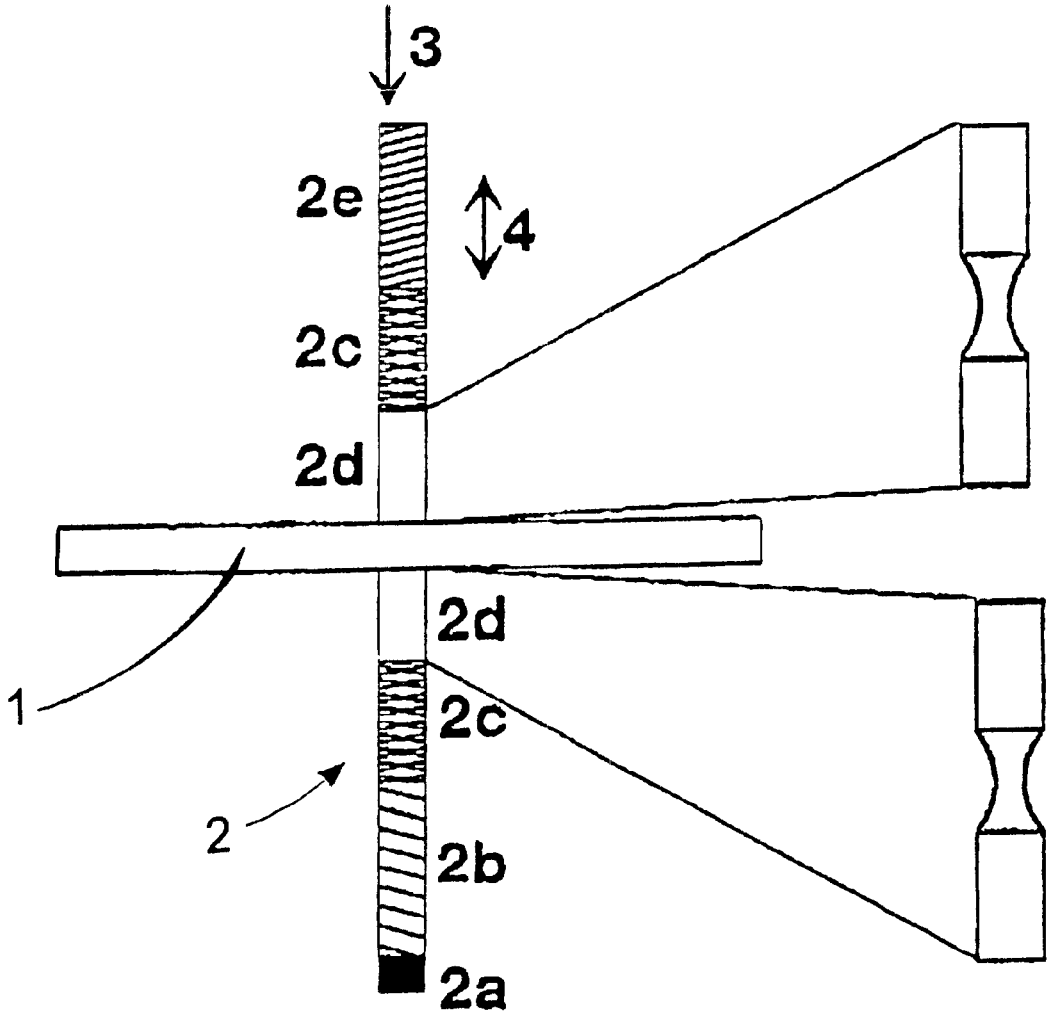
3
2e
4
2c
2d
2d
1
2c
2
2b
2a

ELECTROMAGNETIC ACTUATOR FOR ACTUATING A LIFTING VALVE OF AN INTERNAL COMBUSTION ENGINE

CROSS-REFERENCE TO RELATED APPLICATION

This application is a continuation of copending International Application No. PCT/EP00/03835, filed Apr. 27, 2000, which designated the United States.

BACKGROUND OF THE INVENTION

Field of the Invention

The invention relates to an electromagnetic actuator for actuating a lifting valve of an internal combustion engine. The actuator has an armature that is moved in oscillation between two magnetic coils and carries an armature shank that is guided in the actuator and that acts with an end portion on the shank of the lifting valve. Reference is made by way of example to German Published, Non-Prosecuted Patent Application DE 196 11 547 A1 for the technical background.

An electromagnetic lifting-valve actuating device for an internal combustion engine, also referred to as an electromagnetic actuator, has enormous advantages because of the freedom in terms of valve control times (i.e., in terms of the respective opening and closing point of the lifting valves) but relatively high forces have to be exerted to actuate, in particular, to open the lifting valve. Thus, it is necessary for the magnet coils and armature to have a particular minimum size. However, such systems, requiring a large amount of construction space, cannot readily be accommodated in the space available in an internal combustion engine. Furthermore, such systems, which, due to their type of construction, introduce high reaction forces into the structure of the internal combustion engine while they are functioning, must be considered to be unfavorable with regard to the radiation of noise emissions.

SUMMARY OF THE INVENTION

It is accordingly an object of the invention to provide an electromagnetic actuator for actuating a lifting valve of an internal combustion engine that overcomes the hereinaforementioned disadvantages of the heretofore-known devices of this general type and that demonstrates a measure contributing to solving the above-mentioned problem by having the armature shank be made at least in portions of a material having a specific gravity substantially lower than that of steel.

With the foregoing and other objects in view, there is provided, in accordance with the invention, an electromagnetic actuator for actuating a lifting valve of an internal combustion engine including two magnetic coils and an armature moved in oscillation between the two magnetic coils. The armature has an armature shank with an end portion. The armature shank is guided in the actuator. The end portion is connected to and acts upon the valve shank of the lifting valve. At least portions of the armature shank are of a material having a specific gravity substantially lower than that of steel.

According to the invention, the armature shank, guiding the armature in the actuator and at the same time transmitting its oscillating movement to the lifting valve of the internal combustion engine, is to be manufactured, at least in portions, from a relatively light material to keep the mass to be moved by the actuator as low as possible. The measure makes it possible for the actuator magnet coils to be dimensioned smaller than when an armature shank is used, for example, being manufactured completely from steel. Moreover, when the moved mass is lower, lower reaction forces necessarily occur in the actuator and are introduced into the internal combustion structure surrounding the actuator, so that, at the same time, noise emissions are reduced.

As examples of preferred materials that come under consideration for an armature shank of the invention, mention may be made of titanium or titanium alloys and also ceramic materials that all possess a further advantageous property, to be precise, extremely low (magnetic) relative permeability. Such a measurement variable defines the ferromagnetic property of a material, that is to say, whether or not a material is a magnetic conductor or a magnetic nonconductor.

In accordance with another feature of the invention, the armature shank can be produced completely or partially from titanium, the titanium alloy, or the ceramic.

In accordance with yet another feature of the invention, the end portion is of one of the group consisting of hardened steels, valve steel, rolling-bearing steel, tungsten carbide, SiN, $Al_2O_3$, CerMets, and nonoxidic metal ceramics.

In accordance with a further feature of the invention, the armature shank has a second end portion, an inductively operating measuring system for determining a position of the armature is disposed near the second end portion, and a portion of the second end portion is disposed at least in a region of the measuring system and is of a material having a relative permeability lower than steel.

To be precise, on an electromagnetic actuator for actuating a lifting valve of an internal combustion engine, it may be desirable, in addition, to be capable of determining the respective position of the armature moved in oscillation, for which purpose preferably contactless, in particular, inductively operating, measuring systems may be used. Such a measuring system is preferably disposed near that end portion of the armature shank that is opposite the shank of the lifting valve. Then, not to disturb the measuring system by magnetization of the armature shank in the measurement region, it is proposed, furthermore, to manufacture the armature shank, at least in the region of the inductive measuring system, from a material that (at least in terms of the magnetic field strengths occurring with respect to the invention) is essentially a magnetic nonconductor. The permeability of the material used in the armature shank region is, therefore, to be near that of, for example, air or a vacuum.

In accordance with an added feature of the invention, different portions of the armature shank may include different materials that are selected essentially with regard to the requirements relevant for these portions. The individual portions of the armature shank are shaft stubs of greater or lesser length that are lined up and, assembled together, form the armature shank.

In accordance with an additional feature of the invention, the armature shank has regions, and at least one region of the armature shank has a cross section that is reduced relative to other of the regions of the armature shank.

In accordance with yet an added feature of the invention, the reduced cross-section is a peripheral groove.

In accordance with yet a further feature of the invention, the armature shank has a central portion and the at least one region is in the central portion.

In accordance with yet an additional feature of the invention, the at least one region is of one of the group consisting of titanium, aluminum, Ti—Al alloys, and magnesium.

In accordance with again another feature of the invention, the portion of the second end portion is non-magnetic.

In accordance with a concomitant feature of the invention, the portion is of one of the group consisting of titanium, titanium alloys, ceramics, austenitic steel, aluminum, titanium alloys, aluminum alloys, and magnesium alloys.

Other features that are considered as characteristic for the invention are set forth in the appended claims.

Although the invention is illustrated and described herein as embodied in an electromagnetic actuator for actuating a lifting valve of an internal combustion engine, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawing.

BRIEF DESCRIPTION OF THE DRAWING

The FIGURE is a diagrammatic, side elevational view of an electromagnetic actuator armature according to the invention.

DESCRIPTION OF THE PREFERRED EMBODIMENTS

Referring now to the single figure of the drawing, it is seen that an armature 1 (also called an armature plate) of an electromagnetic actuator for actuating a non-illustrated lifting valve of an internal combustion engine, that is to say opened (and closed).

The entire system is constructed as a mechanical oscillator, in a similar way to the prior art (shown in more detail, for example, in the above-mentioned publication), that is to say suitable spring elements are also provided, which bring about the respectively desired movement of the armature 1 and also of the lifting valve. The lifting valve is supported with the free end of its valve shank on the free end face of the lower end portion 2*a* of a or the armature shank 2 fastened to the armature 1. The armature 1 and, together with it, the armature shank 2 and also the lifting valve of the internal combustion engine are, thus, moved in oscillation along the axis 3 of the armature shank 2 in the direction of the arrow 4. The movement is initiated and maintained by electromagnetic coils, not shown here for the sake of simplicity, which are disposed above and below the armature 1 and, at the same time, surround the armature shank 2. For such a purpose, the magnetic forces generated by the magnet coils act alternately on the armature 1 (or on the armature plate 1). For the sake of completeness, it may also be pointed out that the armature 1 is guided longitudinally displaceably, through its armature shank 2, in the direction of the arrow 4 in non-illustrated guide bushes provided in the actuator.

The armature shank 2 illustrated, and now described in more detail, is composed, as seen in the direction of its longitudinal axis 3, of different portions 2*a* to 2*e* that are or may be of different materials. These materials are at the same time respectively selected essentially with regard to the requirements relevant to these portions 2*a*–2*e*. Thus, the lower end portion 2*a*, already mentioned further above, is preferably made extremely hard to have optimum wearing and sliding properties in terms of punctiform contact with the shank of the lifting valve of the internal combustion engine. Examples of preferred materials for the lower end portion 2*a* include, in particular, hardened steels (valve steel, rolling-bearing steel) or other hard metals, such as, for example, tungsten carbide. In addition, suitable ceramic materials may be used, such as, for example, SiN, which is distinguished by high toughness, or $Al_2O_3$ with its particularly good wear resistance, or CerMets, that is to say nonoxidic metal ceramics.

On both sides of the armature 1 or of the armature plate 1 are located central armature shank portions 2*d*, through which the armature shank 2 is connected to the armature 1. The material for these central armature shank portions 2*d* is, therefore, selected with a view to making possible a simple and reliable connection between the armature shank 2 and the armature 1. The connection is preferably a welded or soldered joint. The material of the central armature portions 2*d* should, therefore, be easily weldable or solderable, so that, in principle, low-alloy steels can be used for these central armature shank portions 2*d*.

Particularly for these central armature shank portions 2*d*, however, a material may also be selected that, by virtue of its properties, makes it possible for the portion 2*d* of the armature shank 2 to be configured, at least in regions, with a cross section that is reduced in relation to the remaining region of the armature shank 2. Such a reduced cross section not only allows a further reduction of the masses moved (in the actuator), but some flexibility may additionally be imparted to the armature shank 2 in the region. The cross-sectional reduction may at the same time be configured in the form of a peripheral groove and functions virtually as a joint in the armature shank 2.

Above all, with a view to a simple control of the deviations in parallelism of the armature plate 1 in relation to the electromagnetic coils already mentioned, which attract the armature plate 1 alternately along the armature shank 2 and temporarily retain it on its surface, such flexibility (or such a joint) is extremely advantageous because it thereby becomes possible for the armature plate 1 to be oriented at an angle to the armature shank 2 that deviates from a right angle. As an example of such flexibility in the form of a cross-sectional reduction in regions (or a peripheral groove), the figure of the drawing illustrates, enlarged, the correspondingly configured armature shank portions 2*d* laterally next to the armature shank 2. To implement such a configuration, for example, titanium, aluminum, Ti—Al alloys, or magnesium are used as preferred materials for the armature shank portion or these armature shank portions 2*d*.

The two central armature shank portions 2*d* are followed along the longitudinal axis 3, as seen in the direction of the two ends of the armature shank 2, by what may be referred to as guide portions 2*c* of the armature shank 2. By these guide portions 2*c*, the armature shank 2 is guided in guide bushes (already mentioned further above and not illustrated for the sake of simplicity) that are incorporated in the actuator or in its housing. In light of the stresses that occur, the material used for the guide portions 2*c* should be relatively hard to achieve optimum wearing and sliding properties. Examples of preferred materials for these guide portions 2*c* are hardened steels, such as valve steel or rolling-bearing steel, and additionally, once again, suitable ceramics, such as, for example, SiN for high toughness or $Al_2O_3$ for particularly good wear resistance.

The lower guide portion 2*c* is followed along the longitudinal axis 3, as seen in the direction of the lower end portion 2*a* of the armature shank 2, by what may be referred to as a spring plate portion 2*b*. Fastened to the spring plate portion 2*b* is a non-illustrated spring plate, on which is supported one of the spring elements, already mentioned further above, which form the oscillatable actuator system. In such a case, as in the case of the spring plates of lifting valves of internal combustion engines, the fastening of the spring plate may take place conventionally, that is to say, through taper pieces provided, for example, with three peripheral noses. A corresponding number of non-illustrated grooves receiving these noses are provided in the spring plate portion 2*b* of the armature shank 2. In light of the loads in the region of the coupling of the spring plate through these taper pieces, the spring plate portion 2*c* will have hard and, at the same time, tough properties; examples of preferred materials for the spring plate portion 2*b* are, therefore, typical martensitic materials, such as, for example, valve steel.

The upper guide portion 2*c* is followed along the longitudinal axis 3, as seen in the direction of the upper free end of the armature shank 2, by what may be referred to as a sensor portion 2*e*, which forms the upper end of the armature portion. In the region of the sensor portion 2*e*, there is provided, in or on the actuator, a non-illustrated inductively operating measuring system. With the aid of the measuring system, the current position of the armature 1 (or, more precisely, of the armature shank 2, that is to say, its sensor portion 2*e*) can be detected. At the same time, to rule out any risk of incorrect measurements, the sensor portion 2*e* of the armature shank 2 will be essentially nonmagnetic, that is to say, the sensor portion 2*e* will not be magnetizable by the electromagnetic coils actuating the armature 1. Such a property of the material consequently to be preferably used for the sensor portion can also be described by the relative permeability of the material for the sensor portion 2*e* to be considerably lower than that of steel (or nickel or cobalt). Preferably, it is to be near that of air or of other nonmagnetic materials, that is to say, at least in terms of the magnetic field strengths occurring here. The material for the sensor portion 2*e* is essentially a magnetic nonconductor. Examples of preferred materials for the sensor portion 2*e* are titanium or titanium alloys or ceramic materials, but, in addition, also austenitic steel, furthermore aluminum, all ceramics and alloys of titanium, aluminum, and magnesium.

Furthermore, the material of at least one, but preferably of a plurality of the portions 2*a* to 2*e* of the armature shank 2 that are described has a specific gravity that is substantially lower than that of steel. Here, the term "substantially" represents an order of magnitude of at least 15%, that is to say, the specific gravity of the material of at least one of the portions 2*a*–2*e* is to be at least 15% below the specific gravity of steel. The criterion is fulfilled, for example, by titanium having a specific gravity of the order of magnitude of 5.8 kg/dm$^3$, as compared with steel, the specific gravity of which is approximately 7.8 kg/dm$^3$, but, in addition, also ceramic material with a specific gravity of the order of magnitude of 4 kg/dm$^3$. As such, taking into account the strength required, the weight of the armature shank 2 could be reduced or, thus, kept as low as possible. As a consequence, there is a contribution to minimizing the masses to be moved by the electromagnetic actuator, and, as a result, allows for the reduction in dimension of the electromagnetic coils setting the armature 1 and ultimately the lifting valve of the internal combustion engine in oscillating movement. Furthermore, in the event of a specific acceleration, required for the functioning of the actuator, of a moved mass that is now smaller, correspondingly lower reaction forces occur, which has a beneficial influence on the noise emissions of the entire system.

With regard to the manufacture of the armature shank 2 described, having a plurality of portions 2*a*–2*e* (or of only some of the portions described here), the various materials of the portions 2*a* to 2*e* respectively adjoining one another can be connected to one another, for example, by various welding methods, such as, for example, friction welding, laser-beam welding, soldering, or capacitor discharge welding. In addition, however, other current connection techniques are also possible, for example screwing, adhesive bonding, or casting together.

It may be pointed out, in conclusion, that both the last-described effect of weight reduction and the effect, described in conjunction with the sensor portion 2*e* of the armature shank 2, of the, at least in the portion 2*e*, nonferromagnetic material can be achieved even when the armature shank 2 is produced completely from titanium or a titanium alloy or from ceramic, that is to say, when the armature shank is not made of the portions 2*a*–2*e* described with reference to the accompanying figure. In addition, of course, a multiplicity of further details, particularly of a structural nature, may have a configuration plainly deviating from the exemplary embodiment illustrated merely in principle, without departing from the contents of the claims.

We claim:

1. In an electromagnetic actuator for actuating a lifting valve of an internal combustion engine, the lifting valve having a valve shank, the actuator having two magnetic coils, an armature assembly comprising:

an armature moved in oscillation between the two magnetic coils;

said armature having an armature shank with an end portion;

said armature shank being guided in the actuator;

said end portion connected to and acting upon the valve shank; and at least portions of said armature shank being of a material having a specific gravity substantially lower than steel.

2. The armature assembly according to claim 1, wherein:

said armature shank has a second end portion;

an inductively operating measuring system for determining a position of said armature is disposed near said second end portion; and a portion of said second end portion is disposed at least in a region of the measuring system and is of a material having a relative permeability substantially lower than steel.

3. The armature assembly according to claim 2, wherein said second end portion is opposite said end portion.

4. The armature assembly according to claim 1, wherein said armature shank is produced completely from one of the group consisting of titanium, a titanium alloy, and ceramic.

5. The armature assembly according to claim 1, wherein said armature shank is produced partially from one of the group consisting of titanium, a titanium alloy, and ceramic.

6. The armature assembly according to claim 2, wherein said armature shank is produced completely from one of the group consisting of titanium, a titanium alloy, and ceramic.

7. The armature assembly according to claim 2, wherein said armature shank is produced partially from one of the group consisting of titanium, a titanium alloy, and ceramic.

8. The armature assembly according to claim 1, wherein different portions of said armature shank are of different materials respectively selected in terms of requirements relevant to each of said different portions.

9. The armature assembly according to claim 1, wherein:

said armature shank has regions; and at least one region of said armature shank has a cross section that is reduced relative to other of said regions of said armature shank.

10. The armature assembly according to claim 1, wherein said end portion is of one of the group consisting of hardened steels, valve steel, rolling-bearing steel, tungsten carbide, SiN, $Al_2O_3$, CerMets, and nonoxidic metal ceramics.

11. The armature assembly according to claim 9, wherein:

said armature shank has a central portion; and said at least one region is in said central portion.

12. The armature assembly according to claim 9, wherein said reduced cross-section is a peripheral groove.

13. The armature assembly according to claim 9, wherein said at least one region is of one of the group consisting of titanium, aluminum, Ti—Al alloys, and magnesium.

14. The armature assembly according to claim 2, wherein said portion of said second end portion is non-magnetic.

15. The armature assembly according to claim 14, wherein said portion is of one of the group consisting of titanium, titanium alloys, ceramics, austenitic steel, aluminum, aluminum alloys, and magnesium alloys.

16. An electromagnetic actuator for actuating a lifting valve of an internal combustion engine, the lifting valve having a valve shank, the actuator comprising:

two magnetic coils;

an armature moved in oscillation between said two magnetic coils;

said armature having an armature shank with an end portion;

said armature shank being guided in the actuator;

said end portion connected to and acting upon the valve shank; and at least portions of said armature shank being of a material having a specific gravity substantially lower than that of steel.

17. The armature assembly according to claim 16, wherein:

said armature shank has a second end portion;

an inductively operating measuring system for determining a position of said armature is disposed near said second end portion; and a portion of said second end portion is disposed at least in a region of said measuring system and is of a material having a relative permeability lower than steel.

18. The armature assembly according to claim 17, wherein said second end portion is opposite said end portion.

19. The armature assembly according to claim 16, wherein said armature shank is produced completely from one of the group consisting of titanium, a titanium alloy, and ceramic.

20. The armature assembly according to claim 16, wherein said armature shank is produced partially from one of the group consisting of titanium, a titanium alloy, and ceramic.

21. The armature assembly according to claim 17, wherein said armature shank is produced completely from one of the group consisting of titanium, a titanium alloy, and ceramic.

22. The armature assembly according to claim 17, wherein said armature shank is produced partially from one of the group consisting of titanium, a titanium alloy, and ceramic.

23. The armature assembly according to claim 16, wherein different portions of said armature shank are of different materials respectively selected in terms of requirements relevant to each of said different portions.

24. The armature assembly according to claim 16, wherein:

said armature shank has regions; and at least one region of said armature shank has a cross section that is reduced relative to other of said regions of said armature shank.

25. The armature assembly according to claim 16, wherein said end portion is of one of the group consisting of hardened steels, valve steel, rolling-bearing steel, tungsten carbide, SiN, $Al_2O_3$, CerMets, and nonoxidic metal ceramics.

26. The armature assembly according to claim 24, wherein:

said armature shank has a central portion; and said at least one region is in said central portion.

27. The armature assembly according to claim 24, wherein said reduced cross-section is a peripheral groove.

28. The armature assembly according to claim 24, wherein said at least one region is of one of the group consisting of titanium, aluminum, Ti—Al alloys, and magnesium.

29. The armature assembly according to claim 17, wherein said portion of said second end portion is non-magnetic.

30. The armature assembly according to claim 29, wherein said portion is of one of the group consisting of titanium, titanium alloys, ceramics, austenitic steel, aluminum, aluminum alloys, and magnesium alloys.

31. The armature assembly according to claim 16, wherein:

said armature shank has regions; and at least one of said regions of said armature shank is a guide portion for guiding said armature shank.

32. The armature assembly according to claim 31, wherein said guide portion is of a material selected from the group consisting of hardened steel and ceramic.

33. The armature assembly according to claim 32, wherein said hardened steel is selected from the group consisting of valve steel and rolling-bearing steel.

34. The armature assembly according to claim 32, wherein said ceramic is selected from the group consisting of SiN and $Al_2O_3$.

35. The armature assembly according to claim 24, wherein:

at least one of said regions of said armature shank is a guide portion for guiding said armature shank; and said guide portion is disposed adjacent said at least one region.

36. The armature assembly according to claim 31, wherein at least another of said regions is a spring plate portion.

37. The armature assembly according to claim 36, wherein said spring plate portion is disposed between said guide portion and said end portion.

38. The armature assembly according to claim 35, wherein:

at least another of said regions is a spring plate portion; and said spring plate portion is disposed between said guide portion and said end portion.

39. The armature assembly according to claim 36, wherein said spring plate portion is of a martensitic material.

40. The armature assembly according to claim 1, wherein:

said armature shank has regions; and at least one of said regions of said armature shank is a guide portion for guiding said armature shank.

41. The armature assembly according to claim 40, wherein said guide portion is of a material selected from the group consisting of hardened steel and ceramic.

42. The armature assembly according to claim 41, wherein said hardened steel is selected from the group consisting of valve steel and rolling-bearing steel.

43. The armature assembly according to claim 41, wherein said ceramic is selected from the group consisting of SiN and $Al_2O_3$.

44. The armature assembly according to claim 9, wherein:

at least one of said regions of said armature shank is a guide portion for guiding said armature shank; and said guide portion is disposed adjacent said at least one region.

45. The armature assembly according to claim 40, wherein at least another of said regions is a spring plate portion.

46. The armature assembly according to claim 45, wherein said spring plate portion is disposed between said guide portion and said end portion.

47. The armature assembly according to claim 44, wherein:

at least another of said regions is a spring plate portion; and said spring plate portion is disposed between said guide portion and said end portion.

48. The armature assembly according to claim 45, wherein said spring plate portion is of a martensitic material.

* * * * *